US006787725B2

(12) United States Patent
Kim et al.

(10) Patent No.: US 6,787,725 B2
(45) Date of Patent: Sep. 7, 2004

(54) SWITCHING MECHANISM OF CIRCUIT BREAKER FOR GAS INSULTED SWITCHGEAR

(75) Inventors: Duk-Rae Kim, Cheongju (KR); Sung-Mo Kang, Cheongju (KR)

(73) Assignee: LG Industrial Systems Co., Ltd., Seoul (KR)

( * ) Notice: Subject to any disclaimer, the term of this patent is extended or adjusted under 35 U.S.C. 154(b) by 0 days.

(21) Appl. No.: 10/387,572

(22) Filed: Mar. 14, 2003

(65) Prior Publication Data

US 2003/0178392 A1 Sep. 25, 2003

(30) Foreign Application Priority Data

Mar. 21, 2002 (KR) ..... 10-2002-0015297
Mar. 21, 2002 (KR) ..... 10-2002-0015296

(51) Int. Cl.[7] ..... H01H 33/88
(52) U.S. Cl. ..... 218/57; 218/59; 218/43

(58) Field of Search ..... 218/43, 51–56, 218/57, 59, 60, 61, 62, 63, 70–73, 78, 84

(56) References Cited

U.S. PATENT DOCUMENTS 3,331,935 A * 7/1967 Milianowicz ..... 218/62
4,438,308 A * 3/1984 Korner et al. ..... 218/59
4,511,775 A * 4/1985 Korner et al. ..... 218/57
4,598,188 A * 7/1986 Schotzau et al. ..... 218/59

* cited by examiner

*Primary Examiner*—Lincoln Donovan
*Assistant Examiner*—M. Fishman
(74) *Attorney, Agent, or Firm*—Greenblum & Bernstein, P.L.C.

(57) ABSTRACT

A switching mechanism of a circuit breaker for a gas insulated switchgear is able to extinguish arc gas by changing a volume of a compressing chamber without increasing a stroke of a movable cylinder and without increasing required output power of an actuator.

10 Claims, 11 Drawing Sheets

SWITCHING MECHANISM OF CIRCUIT BREAKER FOR GAS INSULTED SWITCHGEAR

BACKGROUND OF THE INVENTION

1. Field of the Invention

The present invention relates to a gas insulated switchgear, and particularly, to a switching mechanism of a circuit breaker for a gas insulated switchgear.

2. Description of the Background Art

A high voltage gas insulated switchgear having tens of kV or hundreds of kV rate voltage related to the present invention generally includes a circuit breaker, a current transformer, a disconnecting switch for load line, a disconnecting switch for power source line and a bushing for electrical insulation. The gas insulated switchgear is installed on an electrical power supplying line and is used when a circuit is opened/closed for testing electrical equipment or the electrical power supplying line in a normal usage status. Also, the gas insulated switchgear breaks the circuit between electric source and load when abnormal current due to ground faults or short circuit, etc., is generated in order to protect electrical power supplying system and electrical load apparatuses safely.

Presently, in most countries, in order to operate the electric power supplying system, a six Fluoric Sulfur (abbreviated as $SF_6$) gas insulated switchgear or a switchgear called as an $SF_6$ gas ring main unit is installed on the ground or underground as a branching apparatus and a dividing apparatus of the lines.

One of the principal functions of the high voltage switchgear using the $SF_6$ gas as the insulating material is a function of extinguishing rapidly an arc generated when the circuit is opened or closed.

There are arc extinguishing methods used recently such as an electromagnetic arc rotating type, a thermal expansion type, an arc dividing grid type and a puffer type, etc.

The puffer type can be divided into a straight moving type and a rotating type, and the present invention relates to the straight moving type arc extinguishing method.

As a reference, arc discharging means a status that some of electrode material is evaporated to become gas, and can be referred as gas discharging. In addition, since the electricity is somewhat remained on the end of a moving arc contactor and a fixed arc contactor right after the flowing of electricity is blocked and generates arc discharging to interrupt the electric current blocking, the arc generated when the circuit is closed, that is, tripped in the gas insulated switchgear should be extinguished effectively and rapidly to protect the lines and the load apparatuses safely.

FIG. 1 is a brief view showing an outer appearance of a conventional gas insulated switchgear, FIG. 2 is a cross-sectional view showing inside of a circuit breaker in the conventional gas insulated switchgear, FIG. 3 is a cross-sectional view showing a switching mechanism which is a principal part of the breaker in the conventional gas insulated switchgear, showing the closed circuit, that is, the status of circuit connection, and FIG. 4 is a cross-sectional view showing the switching mechanism which is a principal part of the breaker in the conventional gas insulated switchgear, showing opened circuit, that is, the status of circuit breaking.

As shown in FIG. 1, the gas insulated switchgear 1 comprises: a breaker 10 for breaking a circuit; a current transformer 20 for detecting amount of current flowing on the circuit; a disconnecting switch 30 for load line for breaking connection to load side; a disconnecting switch 40 for power source line for breaking connection to power source side; and a bushing 50 for insulating an electric terminal.

As shown in FIG. 2, the breaker 10 of the gas insulated switchgear 1 comprises: conductors C1 and C2 connected to power source side or to the load side; and a switching mechanism connected to the conductors C1 and C2 to connect or break the circuit, and the switching mechanism can be divided into a fixed portion 10A and a movable portion 10B.

As shown in FIGS. 3 and 4, the switching mechanism which is a principal part of the circuit breaker 10 for the gas insulated switchgear 1 is divided into the fixed portion 10A and the movable portion 10B, and the fixed portion 10A comprises a fixed contactor 11 and a fixed arc contactor 12 located in the fixed contactor 11.

In addition, the movable portion 10B comprises: a main cylinder 13; a movable cylinder 14 movably installed on an inner upper part of the main cylinder 13, the movable cylinder 14 including $SF_6$ gas therein; a cylinder rod 15 located in a compressing chamber 14*a* of the movable cylinder 14 and movable with the movable cylinder 14; a sealing member 16 fixedly installed in the movable cylinder 14 so that an outer circumferential surface of the cylinder rod 15 is abutted thereon for sealing the compressing chamber 14*a*; a connecting rod 17 installed to be connected to a lower part of the cylinder rod 15, and connected to an actuator device (not shown) such as a hydraulic system in order to supply power to the switching mechanism according to a command signal of circuit breaking; a movable arc contactor 18 installed on the upper part of the cylinder rod 15 and selectively connected/separated to/from the fixed arc contactor 11; and a nozzle 19 installed on an upper part of the movable cylinder 14. The movable cylinder 14 and the cylinder rod 15 are connected to each other by a connecting member such as a ring member for connecting (not shown), and therefore, these can move together.

In addition, the conductors C1 and C2 for connecting circuit with the power source or with the load are connected to the fixed contactor 11 of the fixed portion 10A and to the main cylinder 13 of the movable portion 10B respectively, as shown in FIG. 2.

In a normal status that the normal current flows in the circuit between the power source and the load, the movable arc contactor 18 is contacted to the fixed arc contactor 12 to maintain the closed circuit status as shown in FIG. 3, and the conductors C1 and C2 are connected electrically.

On the other hand, when abnormal large current flows due to ground fault or short circuit generated in the circuit between the power source line and the load line, a controller (not shown) recognizes it and outputs a command signal of circuit breaking, and accordingly, the actuator device (not shown) pulls the connecting rod 17 in the arrow direction and the cylinder rod 15 connected to the connecting rod 17 is also moved in the arrow direction. At that time, the movable arc contactor 18 located on the upper part of the cylinder rod 15 and the movable cylinder 14 connected to the cylinder rod 15 are also moved in the arrow direction.

The compressing chamber 14*a* is moved downward together with the cylinder rod 15, and at that time, since the sealing member 16 is fixed, volume of the compressing chamber 14*a* is reduced rapidly and the movable arc contactor 18 is separated from the fixed arc contactor 12 simultaneously.

As described above, at the moment that the movable arc contactor 18 is separated from the fixed arc contactor 12, the $SF_6$ gas in the compressing chamber 14*a* is injected through the nozzle 19 by the pressure to extinguish the arc. However, since the arc generated at the moment that the movable arc contactor 18 is separated from the fixed arc contactor 19, is the gas of high temperature and high pressure, the pressure of the arc is higher than that of the $SF_6$ gas injected through the nozzle 19, and therefore, the injection of $SF_6$ gas is not made effectively. In addition, when the arc gas is expanded, there is a limit of space to accept the gas, and therefore it is difficult to extinguish the arc rapidly.

Therefore, the function of extinguishing the arc by injecting a large amount of the $SF_6$ gas in the compressing chamber 14*a* rapidly, that is, the arc extinguishing speed is an important function of the gas insulated switchgear, and a lot of researches are being proceeded.

A method for increasing $SF_6$ gas injecting pressure by increasing the gas pressure in the compressing chamber had been suggested as a conventional method for improving arc extinguishing speed, however, in above method, required output of the actuator device pulling the connecting rod should be increased in proportion to the gas pressure, and also, stroke between compressed status and expanded status of the compressing chamber should be increased, and therefore, the sizes of the breaker and the gas insulated switchgear are increased and the fabrication cost is increased consequently.

SUMMARY OF THE INVENTION

Therefore, an object of the present invention is to provide a switching mechanism of a circuit breaker for a gas insulated switchgear which is able to improve arc extinguishing function by providing a compressing chamber as a space for expanding arc gas without increasing a stroke between compressed status and expanded status of the compressing chamber when the switching mechanism is operated to circuit breaking position, that is, in trip operation.

Another object of the present invention is to provide a switching mechanism of a circuit breaker for a gas insulated switchgear which is able to improve extinguishing function by compressing a compressing chamber to inject a large amount of insulating gas rapidly when the breaker is tripped.

To achieve the objects of the present invention, as embodied and broadly described herein, there is provided a switching mechanism of a circuit breaker for a gas insulated switchgear comprising: a fixed arc contactor electrically connected to a power source or to a load; a main cylinder fixedly installed to face the fixed arc contactor in a vertical direction; a movable cylinder movably installed on an upper part of the main cylinder, the movable cylinder having a compressing chamber including insulating gas; a cylinder rod extending from a predetermined position of lower part of the main cylinder to the inside of the movable cylinder, and being connected to the movable cylinder and movable with the movable cylinder; a movable arc contactor installed on an upper part of the cylinder rod and contacted/separated selectively to/from the fixed arc contactor depending on vertical movement of the cylinder rod; a nozzle installed on an upper part of the movable cylinder for injecting the insulating gas in the compressing chamber; and a movable sealing means installed between the movable cylinder and the cylinder rod, and movable in a vertical direction in order to provide the compressing chamber of which volume can be varied.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings:

FIG. 5 is a cross-sectional view showing a connected status of the circuit (closed circuit);

FIG. 6 is a cross-sectional view showing a status that the circuit starts to be separated;

FIG. 7 is a cross-sectional view showing expanded status of a compressing chamber by the arc when the circuit is separated;

FIG. 8 is a cross-sectional view showing an opened circuit that the circuit is completely separated;

FIG. 9 is a status view showing a connected status of the circuit (closed circuit);

FIG. 10 is a status view showing a status right before the circuit is completely separated; and FIG. 11 is a status view showing an opened circuit, that is, the circuit is completely separated.

DETAILED DESCRIPTION OF THE PREFERRED EMBODIMENTS

Reference will now be made in detail to the preferred embodiments of the present invention, examples of which are illustrated in the accompanying drawings.

Figure 5:
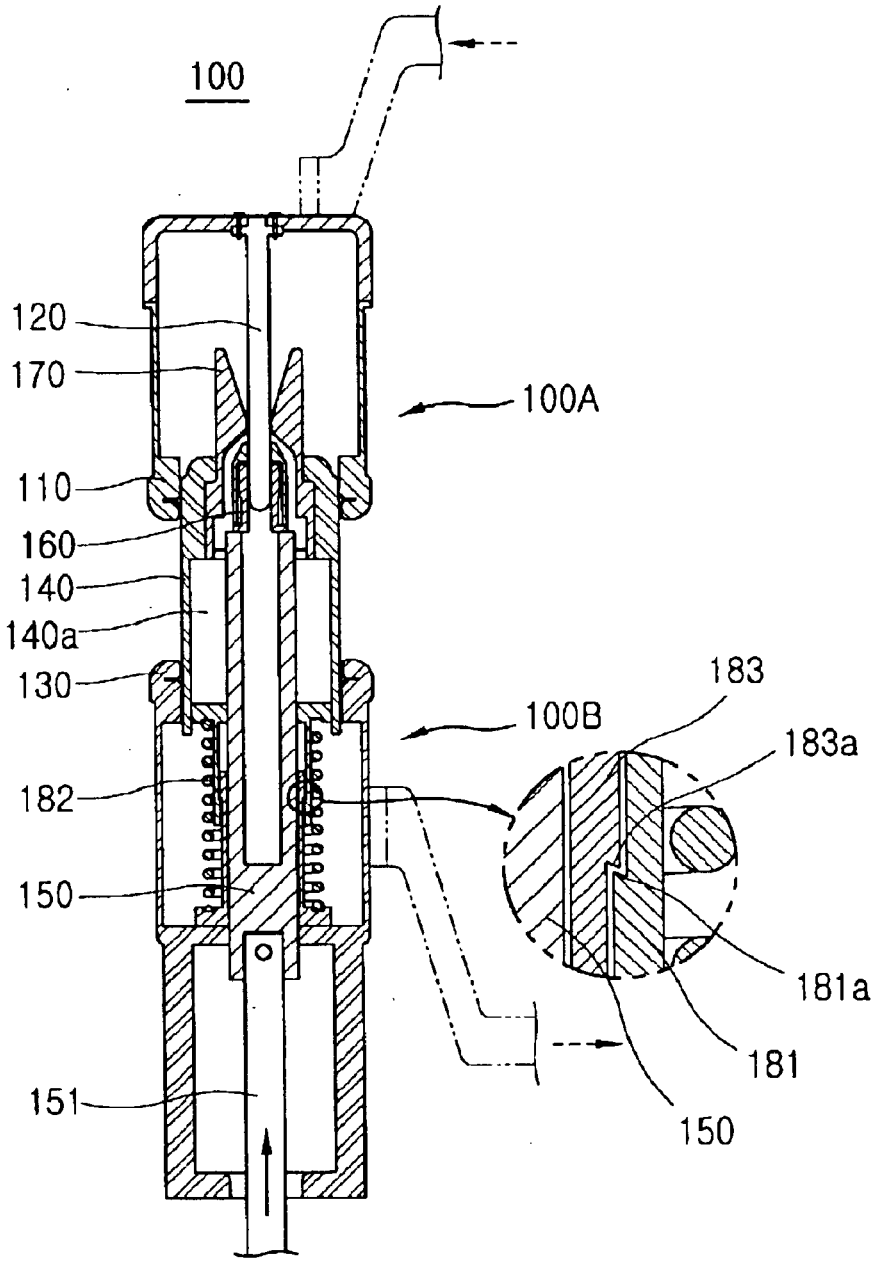
FIGS. 5 through 8 are cross-sectional views showing a switching mechanism which is a principal part of a circuit breaker for a gas insulated switchgear according to a first embodiment of the present invention.

FIG. 5 is a cross-sectional view showing a circuit connection status (closed circuit), as shown therein, a switching mechanism 100 according to a first embodiment of the present invention comprises a fixed portion 100A and a movable portion 100B.

Figure 1:
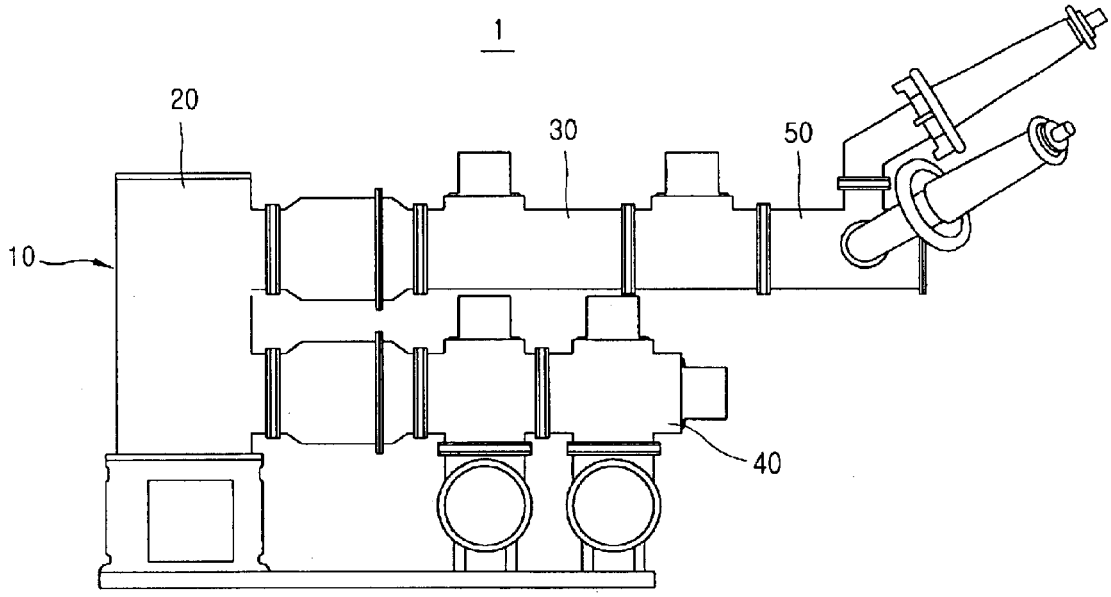
FIG. 1 CONVENTIONAL ART
FIG. 1 is a schematic view showing an outer appearance of a conventional gas insulated switchgear.
Figure 2:
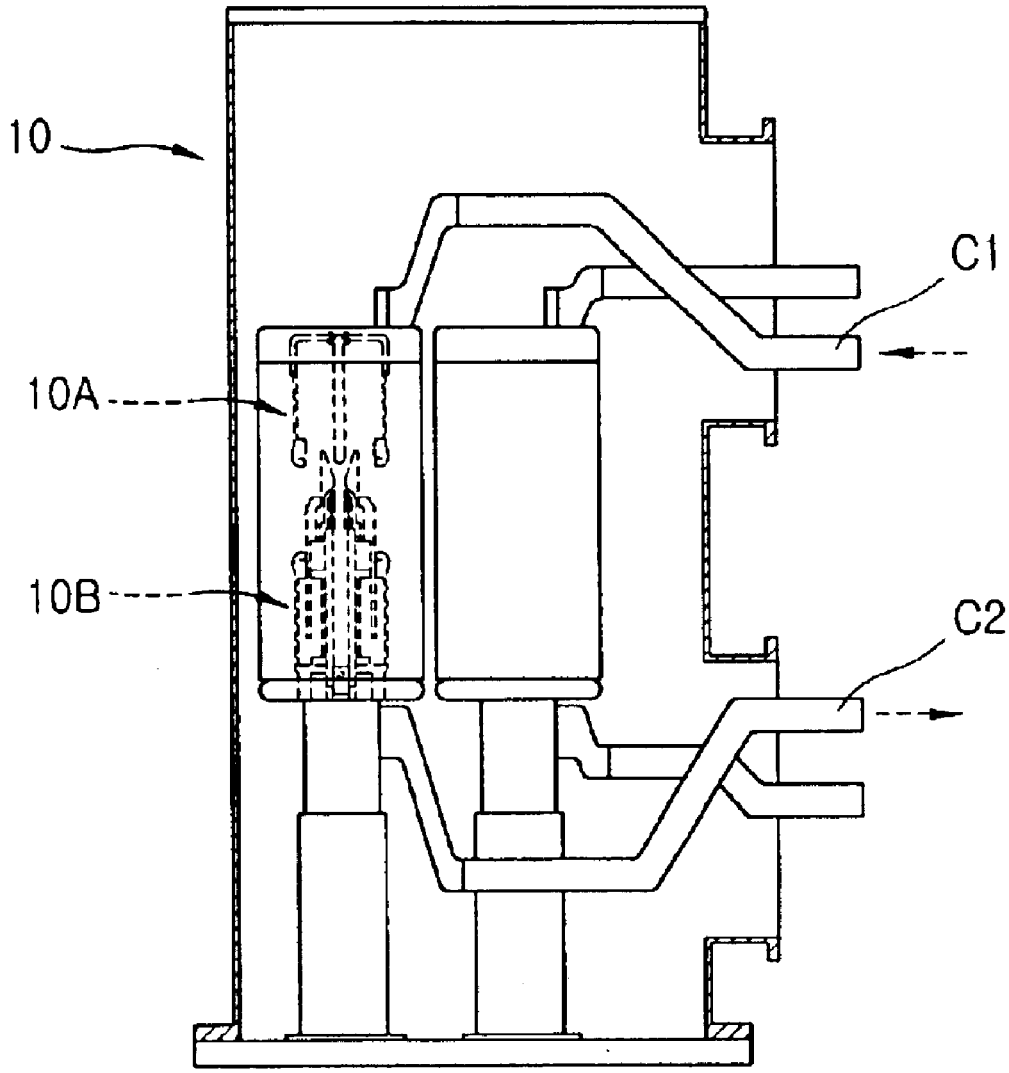
FIG. 2 CONVENTIONAL ART
FIG. 2 is a cross-sectional view showing the inside of a circuit breaker for the conventional gas insulated switchgear.

The fixed portion 100A comprises a fixed contactor 110 and a fixed arc contactor 120 located in the fixed contactor 110. Herein, the fixed contactor 110 and the fixed arc contactor 120 are electrically connected to power source or to a load through conductors C1 and C2 shown in FIG. 2. A movable arc contactor 160 which will be described later is connected to the load in order to construct the circuit when the fixed contactor 110 and the fixed arc contactor 120 are connected to the power source, and connected to the power source when the fixed contactor 110 and the fixed arc contactor 120 are connected to the load.

In addition, the movable portion 100B includes: a main cylinder 130 fixed to face the fixed arc contactor 120 in a vertical direction; a movable cylinder 140 movably installed in an upper part of the main cylinder 130 and selectively contacted/separated to/from the fixed contactor 110, and having a compressing chamber 140*a* containing $SF_6$ gas therein; a cylinder rod 150 extending from a predetermined position of inner upper part of the main cylinder 130 toward an inner part of the movable cylinder 140, and movably together with the movable cylinder 140; a movable arc contactor 160 installed on an upper part of the cylinder rod 150 to be connected/separated selectively to/from the fixed arc contactor 120; and a nozzle 170 installed on an upper part of the movable cylinder 140 for injecting the $SF_6$ gas in the compressing chamber 140*a*. A connecting rod 151 is connected to a lower end part of the movable cylinder 140 in order to provide the power for pulling from an actuator (not shown). The movable cylinder 140 and the cylinder rod 150 is connected with each other by a connecting member such as a connecting ring member (not shown) and are movable together.

Also, the switching mechanism 100 of the circuit breaker for the gas insulated switchgear according to the present invention includes a movable sealing member 181 for sealing the compressing chamber as a characteristic component according to the invention. The movable sealing member 181 is installed between the movable cylinder 140 and the cylinder rod 150, and therefore, is able to move in a vertical direction along with the outer circumferential surface of the movable cylinder 140.

A compression spring 182 for supporting the movable sealing member 181 from the lower portion of the movable sealing member 181, is installed so as to move the movable sealing member 181 according to the compressed status of the compressing chamber 140*a*.

In addition, a spring seat 183 is fixedly disposed as being extended from the lower position of the spring 182 toward the movable sealing member 181, so as to guide the vertical movement of the movable sealing member 181 and support the lower end portion of the spring 182. Therefore, the spring 182 is put between the movable sealing member 181 and the spring seat 183 and supported, and the movable sealing member 181 is moved elastically in a vertical direction by the elastic force of the spring 182 as depending on the pressure of the compressing chamber 140*a*.

The movable sealing member 181 includes a protruded portion on a position facing the upper end portion of the spring seat 183 for restricting the movement of the movable sealing member 181 in the vertical direction. Therefore, when the compressing chamber 140*a* is expanded by the arc gas, the protruded portion is contacted to the upper end portion of the spring seat 183 and stopped, and thereby, the movement of the movable sealing member 181 in the vertical direction, especially in a downward direction is restricted. And as shown by the enlarged cross sectional view in a dotted circle in FIG. 5, the movable sealing member 181 has another protruded portion 181*a* and the spring seat 183 also has corresponding protruded portion 183*a* with the protruded portion 181*a*. Thus, when the compressing chamber 140*a* is restored its original state by the spring 182, the protruded portion 181*a* is contacted to the corresponding protruded portion 183*a* of the spring seat 183 and stopped, and thereby, the movement of the movable sealing member 181 in the vertical direction, especially in a upward direction can be restricted.

The movable sealing member 181 and the spring seat 183 may be formed in various shapes, however, it is desirable that these are formed as pipe shape for smooth movement of the movable sealing member 181.

The arc gas is generated on the arc contactors 120 and 160 right after the trip is operated for breaking abnormal current. At that time, as the compressing chamber 140*a* is compressed by downward movements of the connecting rod 151, the cylinder rod 150 and the movable cylinder 140, the $SF_6$ gas for arc extinguishing in the compressing chamber 140*a* is injected toward the arc gas through the nozzle 170. However, the momentary pressure of the generated arc gas is higher than the injecting pressure of the $SF_6$ gas through the nozzle 170, and therefore, the arc gas is expanded toward the inside of the compressing chamber 140*a*. Then, the pressure of the compressing chamber 140*a* is increased by the expansion of the arc gas, and compresses the movable sealing member 181 downward. At that time, the movable sealing member 181 moves downward as compressing the compression spring 182 to increase the volume of the compressing chamber 140*a*.

When the arc is extinguished by the expansion of arc gas and the $SF_6$ gas, the pressure in the compressing chamber 140*a* increased by the expanded arc gas becomes lower than the elastic force of the spring 182, and therefore, the movable sealing member 181 rises by the elastic force of the spring 182 and the gas in the compressing chamber 140*a* is discharged slowly through the nozzle 170.

Hereinafter, operations and effects of the switching mechanism of the circuit breaker for the gas insulated switchgear according to the first embodiment of the present invention will be described as follows with reference to FIGS. 5 through 8.

FIG. 5 is a cross-sectional view showing the switching mechanism of the circuit breaker for the gas insulated switchgear according to the first embodiment of the present invention in the status that the circuit is connected (closed circuit). As shown therein, when the connecting rod 151 rises by the power of pulling from the actuator (not shown) for connecting the circuit, the cylinder rod 150 connected to the connecting rod 151 is also risen and the movable cylinder 140 connected to the cylinder rod 150 is also risen. Therefore, the movable arc contactor 160 connected to the upper end portion of the cylinder rod 150 is contacted to the fixed arc contactor 120, and therefore, the conductors C1 and C2 which are respectively connected to the power source and to the load are connected thereto, then, the circuit between the power source and the load is short circuited, that is, becomes a closed circuit.

When an abnormal current by the ground faults or short circuit is generated on the circuit in the state of closed circuit as shown in FIG. 5, a sensing means (not shown) recognizes the abnormal current and a control signal for commanding the actuator to generate power for breaking the abnormal current is outputted from a controlling circuit (not shown) to the actuator. Then, the connecting rod 151 connected to the actuator is descended by the pulling power of the actuator, the cylinder rod 150 connected to the connecting rod 151 starts to descend, and accordingly, the movable cylinder 140 also starts to descend, and the movable arc contactor 160 starts to be separated from the fixed arc contactor 120. As described above, the switching mechanism from the status that the movable arc contactor 160 starts to be separated from the fixed arc contactor 120 to the status right before the arc is generated is shown in FIG. 6, and at that time, the compressing chamber 140*a* is compressed by the descending movable cylinder 140, and the $SF_6$ gas in the compressing chamber 140*a* is injected through the nozzle 170.

Figure 6:
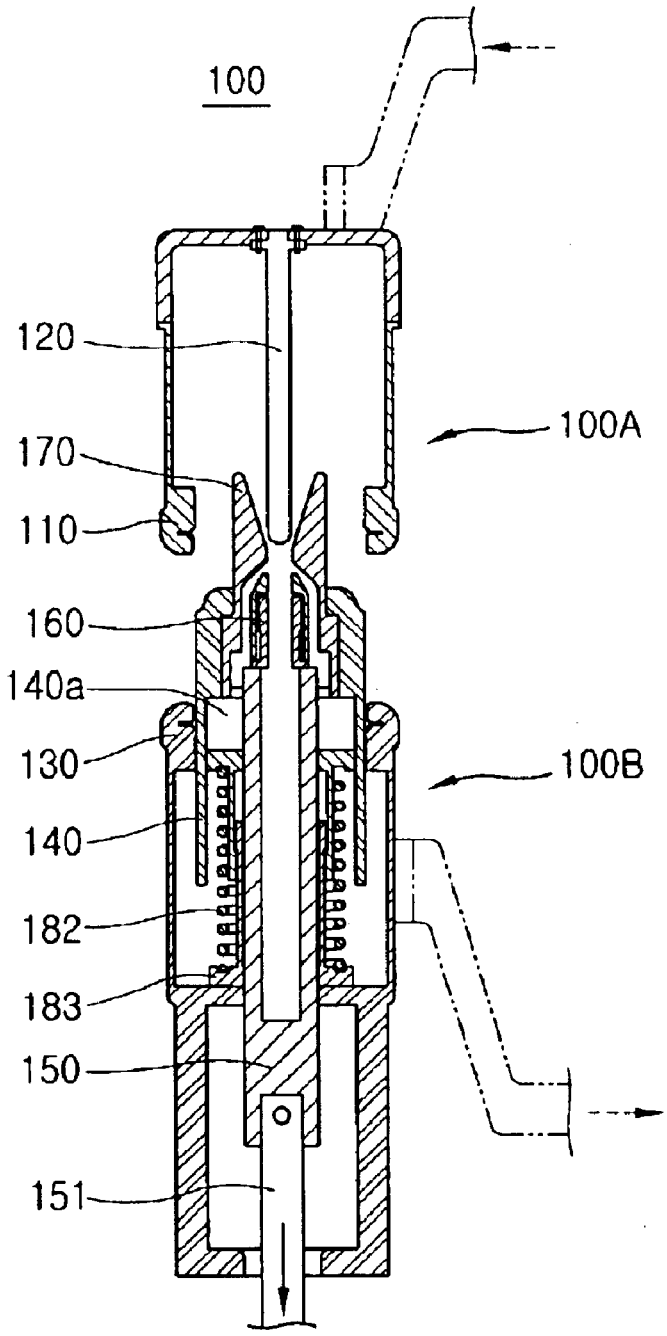
Figure 7:
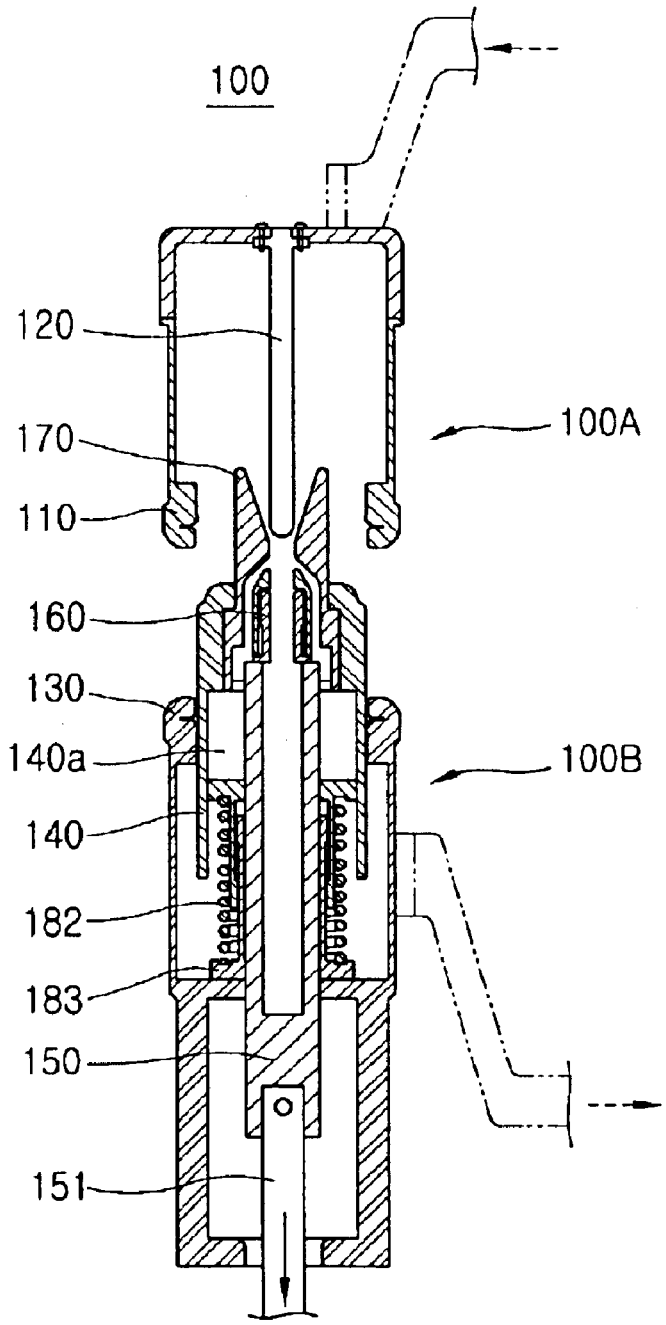
Figure 8:
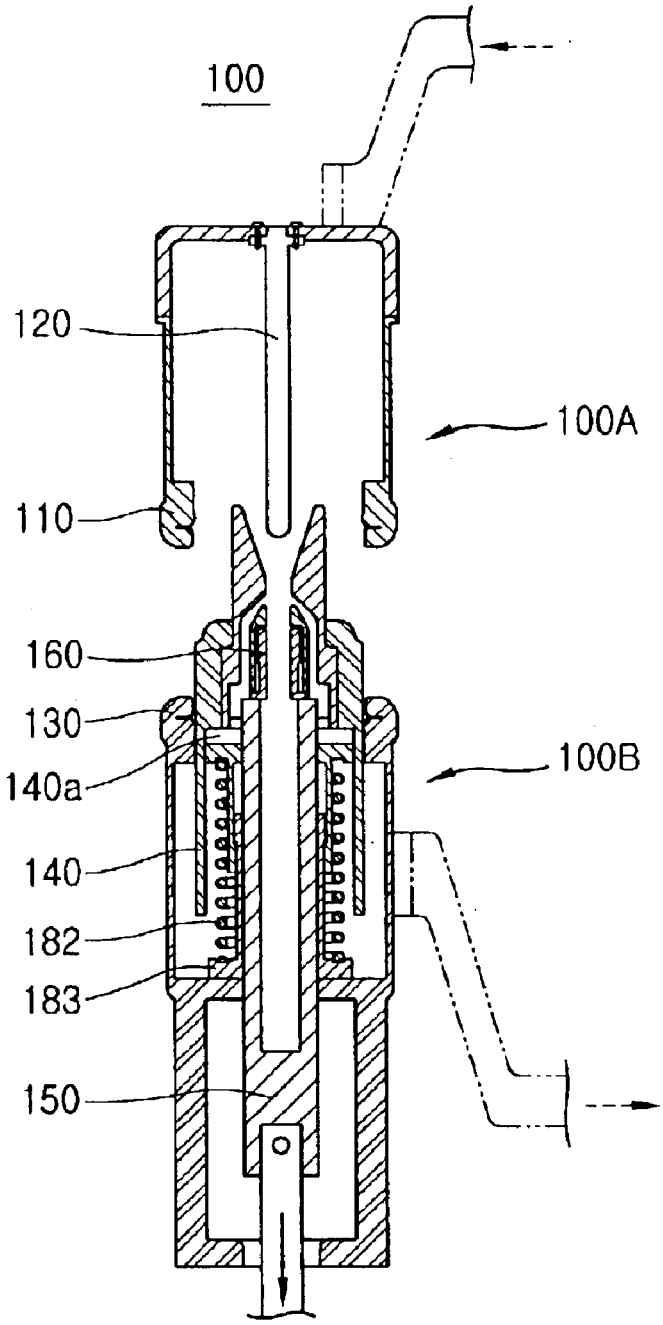

When the connecting rod 151 is more descended from the status shown in FIG. 6, the cylinder rod 150 connected to the connecting rod 151 is descended more, and accordingly, the movable cylinder 140 is also descended more, the movable arc contactor 160 is separated from the fixed arc contactor 120 and the arc is generated. The generated arc gas is expanded into the compressing chamber 140*a* and compresses the movable sealing member 181 downward, and then, the movable sealing member 181 is descended until the protruded portion is contacted to the upper end portion of the spring seat 183 and stopped. Therefore, the spring 182 is compressed by the descending movable sealing member 181 and the fixed spring seat 183. The switching mechanism in the state that the compressing chamber 140*a* is expanded by the arc gas is shown in FIG. 7. As shown in FIG. 7, the arc gas is expanded into the compressing chamber 140*a* and mixed with the $SF_6$ insulating gas, and thereby, the arc gas is rapidly extinguished.

When the expanded arc gas is extinguished, the gas pressure in the compressing chamber 140*a* becomes less than the elastic force of the spring 182, and therefore, the compressed spring 182 extends, and at the same time, pushes the movable sealing member 181 upward. Therefore, the expanded compressing chamber 140*a* is compressed again, and the movable arc contactor 160 is completely separated from the fixed arc contactor 120, and the switching mechanism becomes the status shown in FIG. 8.

As described above, the switching mechanism according to the embodiment of the present invention provides a space where the arc gas can be expanded using the compressing chamber 140*a*, that is, provides the space where the arc gas can be expanded by moving the movable sealing member 181 downward due to the elastic force of the compression spring 182 when the arc generated to increase the volume of the compressing chamber 140*a*, and makes the arc gas mixed with the $SF_6$ insulating gas in the compressing gas 140*a*, and thereby, the arc gas can be extinguished rapidly.

Therefore, the arc gas can be extinguished rapidly without increasing the stroke of the movable cylinder 140 and without increasing the required output of the actuator, and at the same time, the arc gas is mixed with the $SF_6$ gas, and therefore, the extinguishing function of the switching mechanism of the circuit breaker in the gas insulated switchgear can be improved.

Meanwhile, a switching mechanism of a circuit breaker for the gas insulated switchgear according to a second embodiment of the present invention will be described with reference to FIGS. 9 through 11 as follows.

Figure 9:
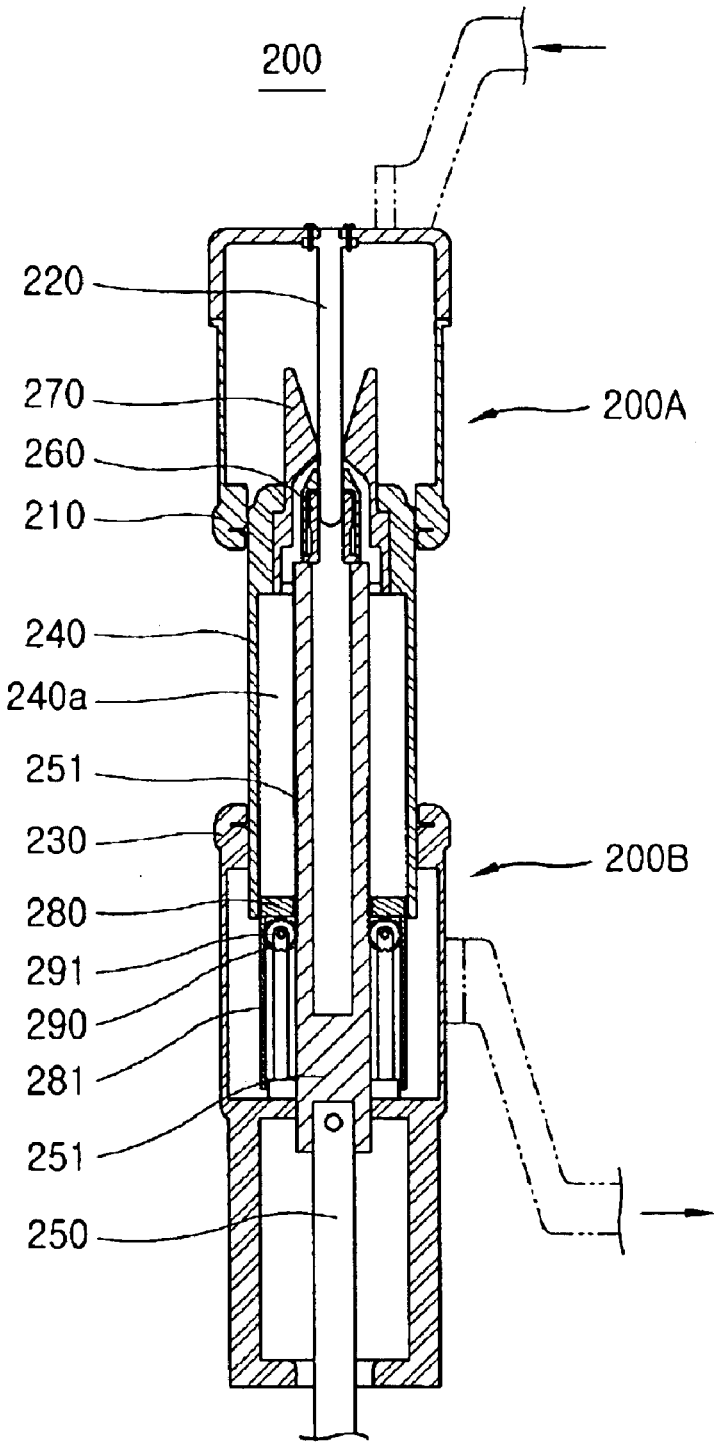
FIGS. 9 through 11 are views showing a switching mechanism of a circuit breaker for the gas insulated switchgear according to a second embodiment of the present invention.
Figure 10:
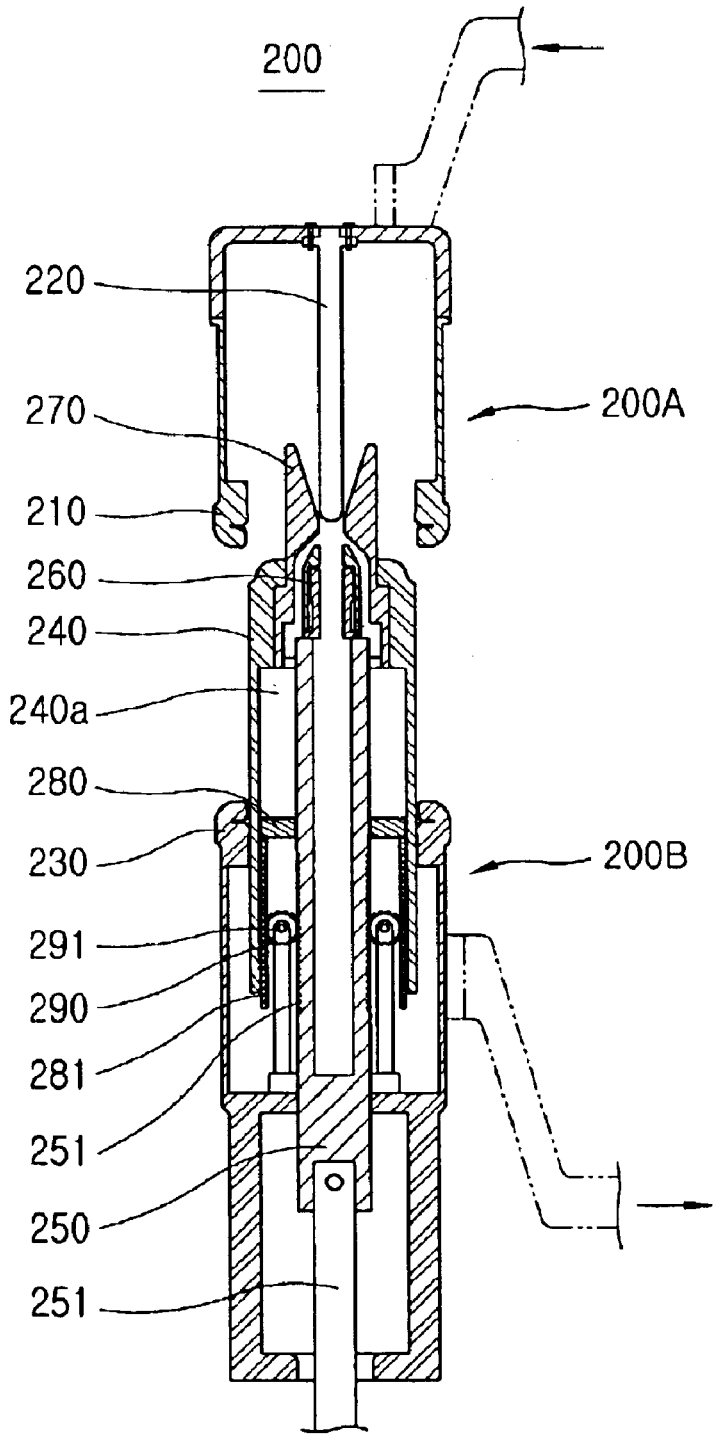
Figure 11:
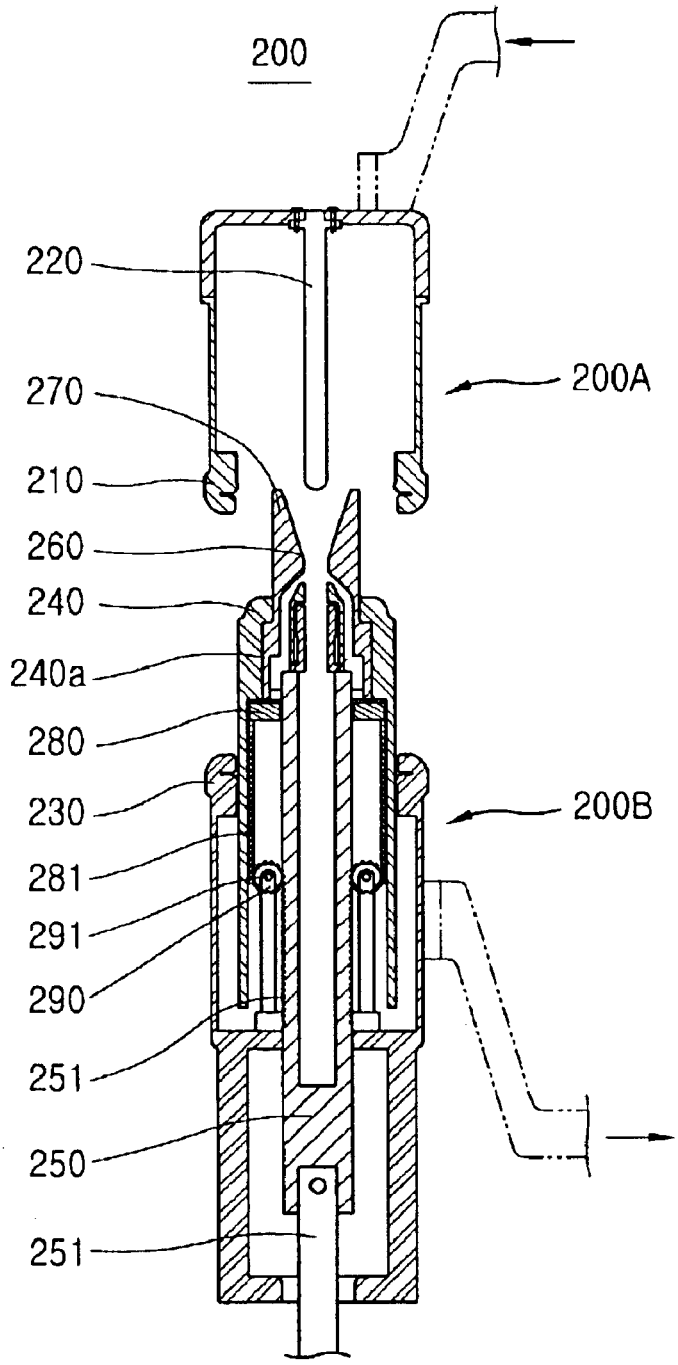

FIG. 9 is a status view showing a connected status of the circuit (closed circuit), FIG. 10 is a status view showing a status right before the circuit is completely separated, and FIG. 11 is a status view showing an opened circuit, that is, the circuit is completely separated.

As shown therein, the switching mechanism 200 of the circuit breaker for the gas insulated switchgear according to the second embodiment of the present invention can be divided into a fixed portion 200A and a movable portion 200B.

The fixed portion 200A includes a fixed contactor 210 and a fixed arc contactor 220 located in the fixed contactor 210. Herein, the fixed contactor 210 and the fixed arc contactor 220 are electrically connected to power source or to a load through the conductors C1 and C2 shown in FIG. 2. A movable arc contactor 260 which will be described later is connected to the load in order to construct the circuit when the fixed contactor 210 and the fixed arc contactor 220 are connected to the power source, and connected to the power source when the fixed contactor 210 and the fixed arc contactor 220 are connected to the load.

In addition, the movable portion 100B includes: a main cylinder 230 fixed to face the fixed arc contactor 220 in a vertical direction; a movable cylinder 240 movably installed in an upper part of the main cylinder 230 and selectively contacted/separated to/from the fixed contactor 210, and having a movable chamber 240*a* including $SF_6$ gas therein; a cylinder rod 250 extending from a predetermined position of an inner upper part of the main cylinder 230 to an inner part of the movable cylinder 240, and movable with the movable cylinder 240; a movable arc contactor 260 installed on an upper part of the cylinder rod 250 to be connected/separated selectively to/from the fixed arc contactor 220; and a nozzle 270 installed on an upper part of the movable cylinder 240 for injecting the $SF_6$ gas in the compressing chamber 240*a*. A connecting rod 251 for providing the cylinder rod 250 with the power from an actuator means such as a hydraulic cylinder is connected to the cylinder rod 250.

The movable cylinder 240 and the cylinder rod 250 are connected with each other by a connecting member such as a connecting ring member (not shown), and can be moved together.

As a characteristic component of the switching mechanism 200 of the circuit breaker for the gas insulated switchgear according to the second embodiment of the present invention, there is provided a movable sealing member 280 located between the cylinder rod 250 and the movable cylinder 240 to seal the compressing chamber 240*a*, and a first rack gear 281 disposed on a side surface of the movable sealing member 280 so as to be movable along with the outer circumferential surface of the cylinder rod 250.

A second rack gear 251*a* is disposed on an outer circumferential surface of the cylinder rod 250.

A pinion gear 290 is installed between the first and second rack gears 281 and 251*a* so as to be meshed with the gears 281 and 251*a*, and the pinion gear 290 is supported by a shaft 291 so as to be movable in the movable contactor 230.

Therefore, when the connecting rod 251 connected to the cylinder rod 250 is pulled down by the power from the actuator such as the hydraulic cylinder and moved downward, the pinion gear 290 moves the movable sealing member 280 in a direction opposite to the cylinder rod 250, that is, in an upward direction while rotating as centering around the shaft 291.

The first rack gear 281 and the second rack gear 250*a* may be installed as separate members respectively from the cylinder rod 250 and the movable sealing member 280, however, it is desirable that these are formed integrally with the cylinder rod 250 and the movable sealing member 280 respectively since the number of components can be reduced.

Hereinafter, operations and effects of the switching mechanism of the circuit breaker for the gas insulated switchgear according to another embodiment of the present invention will be described with reference to FIGS. 9 through 11.

When the connecting rod 251 connected to the actuator means is moved upward in order to connect the circuit, the cylinder rod 250 connected to the connecting rod 251 is moved upward, and accordingly, the movable cylinder 240 connected to the cylinder rod 250 by the connecting member (not shown) is moved upward. Therefore, the movable arc contactor 260 installed on the upper part of the cylinder rod 250 is also moved upward to contact to the fixed arc contactor 220, and therefore, the circuit is connected, that is, a closed circuit is formed between the power source and the load. At that time, the pinion gear 290 is rotated in a counter-clockwise direction in Figure by the second rack gear 250*a* disposed on the outer circumferential surface of the rising cylinder rod 250, and therefore, the first rack gear 281 meshed with the pinion gear 290 is moved downward and the movable sealing member 280 is moved downward to increase the volume of the compressing chamber 240*a*. The switching mechanism in the state that the movable arc contactor 260 is contacted to the fixed arc contactor 220 in above described operations to connect the two conductors C1 and C2, and at the same time, in the state that the volume of the compressing chamber 240*a* is increased is shown in FIG. 9.

When an abnormal current is flowed on the circuit due to accidents such as short circuit or ground faults in the circuit connected status, a sensing means recognizes the abnormal current and a control signal for commanding the actuator to generate power for breaking the abnormal current is outputted from a controlling circuit (not shown) to the actuator. Then, the connecting rod 251 connected to the actuator is descended by the pulling power of the actuator, the cylinder rod 250 connected to the connecting rod 251 starts to descend, and accordingly, the movable cylinder 240 also starts to descend, and the movable arc contactor 260 starts to be separated from the fixed arc contactor 220. As described above, the switching mechanism from the status that the movable arc contactor 260 starts to be separated from the fixed arc contactor 220 to the status right before the arc is generated is shown in FIG. 10. At that time, the movable chamber 240*a* is compressed by the descending movable cylinder 240 and the rising movable sealing member 280, and accordingly, the $SF_6$ gas in the compressing chamber 240*a* is injected through the nozzle 270 to extinguish the arc generated between the arc contactors 220 and 260. When the connecting rod 251 is pulled down in the initial stage of the circuit breaking operation, the cylinder rod 250 connected to the connecting rod 251 is also pulled down more.

At the same time, the movable cylinder 240 connected to the cylinder rod 250 is moved downward with the cylinder rod 250.

As the cylinder rod 250 is pulled more, the pinion gear 290 is rotated in a clockwise direction as centering around the shaft 291 by the first rack gear 251*a* formed on the outer circumferential surface of the cylinder rod 250, and accordingly, the second rack gear 281 meshed with the pinion gear 290 and the movable sealing member 280 are moved in a direction opposite to the cylinder rod 250, that is, toward upper direction.

Figure 3:
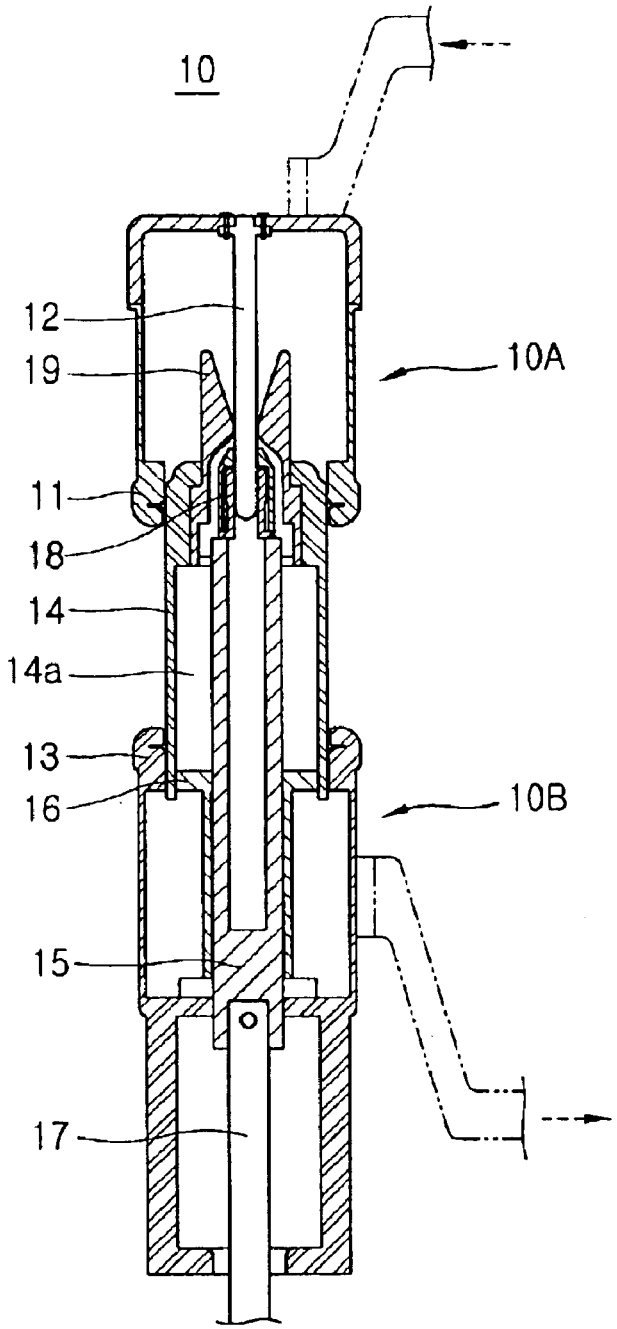
FIG. 3 CONVENTIONAL ART
FIG. 3 is a cross-sectional view showing a switching mechanism which is a principal part of the circuit breaker for the gas insulated switchgear, showing a closed circuit, that is, a circuit between the power source and load is connected.
Figure 4:
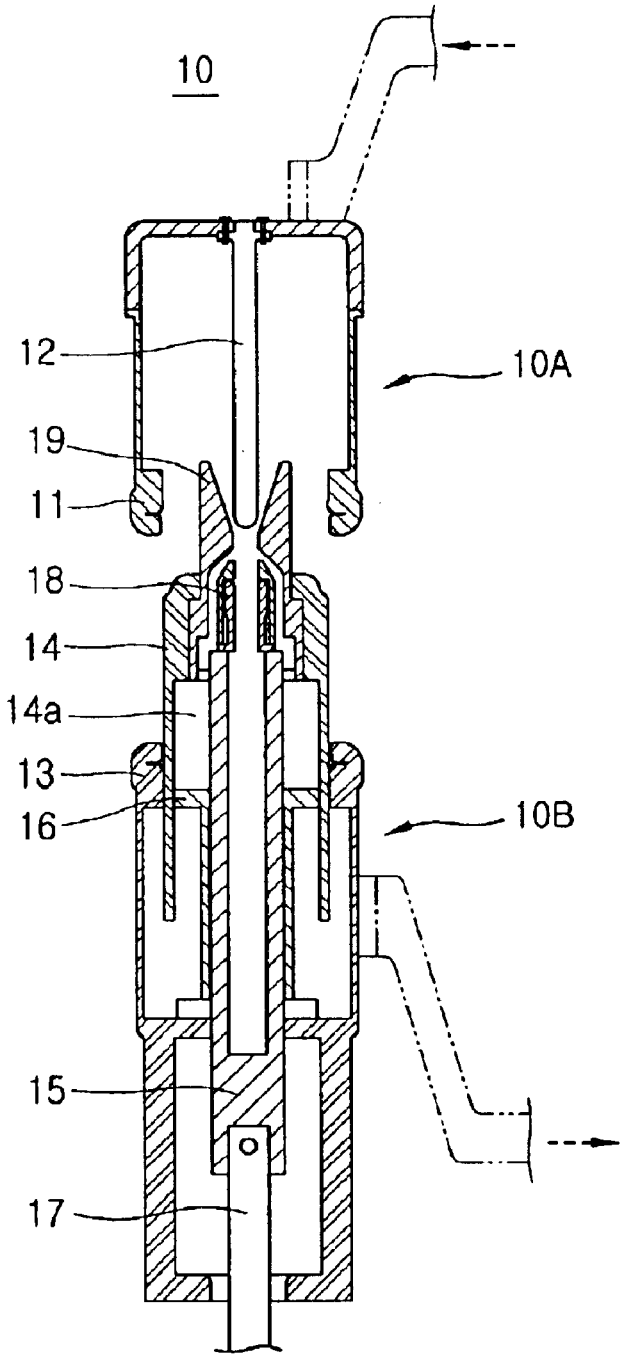
FIG. 4 CONVENTIONAL ART
FIG. 4 is a cross-sectional view showing a switching mechanism which is a principal part of the circuit breaker for the gas insulated switchgear, showing an opened circuit, that is, a circuit between the power source and load is broken.

At that time, as the movable cylinder 240 is moved downward and the movable sealing member 280 is moved upward, the compressing chamber 240*a* is compressed rapidly more than two times as that of the conventional art shown in FIGS. 3 and 4.

According to the present invention, the compressing chamber 240*a* can be compressed rapidly more than two times as that of the conventional art by relative movements of the movable cylinder 240 and the movable sealing member 280 without increasing the required output power of the actuator means, and the pressure of the compressing chamber 240*a* can be increased rapidly.

Therefore, a large amount of $SF_6$ gas can be injected rapidly through the nozzle 270 by rapid pressure rising in the compressing chamber 240*a* without increasing the stroke of the movable cylinder 240 or without increasing the required output of the actuator means, and thereby, the arc extinguishing function can be improved.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. A switching mechanism of a circuit breaker for a gas insulated switchgear comprising:

a fixed arc contactor electrically connected to an electric power source or to a load;

a main cylinder fixedly installed to face the fixed arc contactor in a vertical direction;

a movable cylinder movably installed on an upper part of the main cylinder, the movable cylinder having a compressing chamber containing insulating gas therein;

a cylinder rod extending from a predetermined position of an inner lower part of the main cylinder toward inside of the movable cylinder, and being connected to the movable cylinder so as to be movable with the movable cylinder;

a movable arc contactor installed on an upper part of the cylinder rod and contacted/separated selectively to/from the fixed arc contactor depending on the vertical movement of the cylinder rod;

a nozzle installed on an upper part of the movable cylinder for injecting the insulating gas in the compressing chamber; and a movable sealing means installed between the movable cylinder and the cylinder rod, and movable in a vertical direction for providing the compressing chamber of which a volume can be varied, wherein the movable sealing means comprises;

a movable sealing member located between the cylinder rod and the movable cylinder to seal the compressing chamber and moved along with an outer circumferential surface of the movable cylinder; and a spring installed on a position supporting the movable sealing member to move the movable sealing member elastically according to pressure status of the compressing chamber, wherein the movable sealing member includes a protruded portion formed on a position facing an upper end portion of a spring seat for restricting the vertical movement of the movable sealing member.

2. The mechanism of claim 1, wherein the movable sealing means further comprises:

a spring seat fixedly extended from a lower position of the spring toward the movable sealing member, so as to guide the vertical movement of the movable sealing member and to support a lower end portion of the spring.

3. The mechanism of claim 2, wherein the movable sealing member and the spring seat are formed as pipe shapes.

4. The mechanism of claim 1, wherein the movable sealing member and the spring seat are formed as pipe shapes.

5. A switching mechanism of a circuit breaker for a gas insulated switchgear comprising:

a fixed arc contactor electrically connected to an electric power source or to a load;

a main cylinder fixedly installed to face the fixed arc contactor in a vertical direction;

a movable cylinder movably installed on an upper part of the main cylinder, the movable cylinder having a compressing chamber containing insulating gas therein;

a cylinder rod extending from a predetermined position of an inner lower part of the main cylinder toward inside of the movable cylinder, and being connected to the movable cylinder so as to be movable with the movable cylinder;

a movable arc contactor installed on an upper part of the cylinder rod and contacted/separated selectively to/from the fixed arc contactor depending on the vertical movement of the cylinder rod;

a nozzle installed on an upper part of the movable cylinder for injecting the insulating gas in the compressing chamber; and a movable sealing means installed between the movable cylinder and the cylinder rod, and movable in a vertical direction for providing the compressing chamber of which a volume can be varied, wherein the movable sealing means comprises:

a movable sealing member located between the cylinder rod and the movable cylinder to seal the compressing chamber, and including a first rack gear on a side surface thereof so as to move along with an outer circumferential surface of the cylinder rod;

a second rack gear disposed on the outer circumferential surface of the cylinder rod; and a pinion gear installed to be meshed with the first rack gear and the second rack gear, and moving the movable sealing member toward opposite direction of the moving direction of the cylinder rod.

6. A switching mechanism of a circuit breaker for a gas insulated switchgear comprising:

a fixed arc contactor electrically connected to an electric power source or to a load;

a main cylinder fixedly installed to face the fixed arc contactor in a vertical direction;

a movable cylinder movably installed on an upper part of the main cylinder, the movable cylinder having a compressing chamber containing insulating gas therein;

a cylinder rod extending from a predetermined position of an inner lower part of the main cylinder toward inside of the movable cylinder, and being connected to the movable cylinder so as to be movable with the movable cylinder;

a movable arc contactor installed on an upper part of the cylinder rod and contacted/separated selectively to/from the fixed arc contactor depending on the vertical movement of the cylinder rod;

a nozzle installed on an upper part of the movable cylinder for injecting the insulating gas in the compressing chamber; and a movable sealer installed between the movable cylinder and the cylinder rod, and movable in a vertical direction to provide the compressing chamber of which a volume can be varied, wherein the movable sealer comprises;

a movable sealing member located between the cylinder rod and the movable cylinder to seal the compressing chamber and moved along with an outer circumferential surface of the movable cylinder; and a spring installed at a position supporting the movable sealing member to move the movable sealing member elastically according to pressure status of the compressing chamber, wherein the movable sealing member includes a protruded portion formed on a position facing an upper end portion of a spring seat for restricting the vertical movement of the movable sealing member.

7. The mechanism of claim 6, wherein the movable sealer further comprises:

a spring seat fixedly extended from a lower position of the spring toward the movable sealing member, so as to guide the vertical movement of the movable sealing member and to support a lower end portion of the spring.

8. The mechanism of claim 7, wherein the movable sealing member and the spring seat are formed as pipe shapes.

9. The mechanism of claim 6, wherein the movable sealing member and the spring seat are formed as pipe shapes.

10. A switching mechanism of a circuit breaker for a gas insulated switchgear comprising:

a fixed arc contactor electrically connected to an electric power source or to a load;

a main cylinder fixedly installed to face the fixed arc contactor in a vertical direction;

a movable cylinder movably installed on an upper part of the main cylinder, the movable cylinder having a compressing chamber containing insulating gas therein;

a cylinder rod extending from a predetermined position of an inner lower part of the main cylinder toward inside of the movable cylinder, and being connected to the movable cylinder so as to be movable with the movable cylinder;

a movable arc contactor installed on an upper part of the cylinder rod and contacted/separated selectively to/from the fixed arc contactor depending on the vertical movement of the cylinder rod;

a nozzle installed on an upper part of the movable cylinder for injecting the insulating gas in the compressing chamber; and a movable sealer installed between the movable cylinder and the cylinder rod, and movable in a vertical direction to provide the compressing chamber of which a volume can be varied, wherein the movable sealer comprises:

a movable sealing member located between the cylinder rod and the movable cylinder to seal the compressing chamber, and including a first rack gear on a side surface thereof so as to move along with an outer circumferential surface of the cylinder rod;

a second rack gear disposed on the outer circumferential surface of the cylinder rod; and a pinion gear installed to be meshed with the first rack gear and the second rack gear, and moving the movable sealing member in a direction opposite the moving direction of the cylinder rod.

* * * * *

UNITED STATES PATENT AND TRADEMARK OFFICE

CERTIFICATE OF CORRECTION

PATENT NO. : 6,787,725 B2
DATED : September 7, 2004
INVENTOR(S) : D. Kim et al.

It is certified that error appears in the above-identified patent and that said Letters Patent is hereby corrected as shown below:

Title page,
Item [54], Title, "INSULTED" should be -- INSULATED --.

Column 10,
Line 46, ";" should be -- : --.

Column 12,
Line 1, ";" should be -- : --.

Signed and Sealed this

Seventeenth Day of May, 2005

JON W. DUDAS
*Director of the United States Patent and Trademark Office*